United States Patent [19]

Bargeman

[11] 4,203,343

[45] May 20, 1980

[54] SNARE DRUM CONTROL MECHANISM

[76] Inventor: Harry Bargeman, 56 Park Gardens, Hawkwell, nr. Hockley, Essex, England

[21] Appl. No.: 957,208

[22] Filed: Nov. 3, 1978

[51] Int. Cl.[2] ..... G10D 13/02

[52] U.S. Cl. ..... 84/415

[58] Field of Search ..... 84/411 R, 415

[56] References Cited

U.S. PATENT DOCUMENTS

| | | | |
|---|---|---|---|
| 1,894,068 | 1/1933 | Soderberg | 84/415 |
| 2,430,184 | 11/1947 | Peacock | 84/411 |
| 2,433,200 | 12/1947 | Cordes | 84/415 |
| 2,834,244 | 5/1958 | Willits | 84/415 X |
| 3,186,289 | 6/1965 | Kester, Jr. | 84/415 X |
| 4,138,920 | 2/1979 | Meador | 84/415 |

*Primary Examiner*—L. T. Hix
*Assistant Examiner*—Thomas H. Tarcza
*Attorney, Agent, or Firm*—Leydig, Voit, Osann, Mayer & Holt, Ltd.

[57] ABSTRACT

A drum snare control mechanism comprises a frame on which a snare is supported and one or more pairs of snare-engaging members are supported on stems slidable within the frame and movable by cams to bring the pairs of snare-engaging members selectively into and out of contact with a length of the snare, or different lengths of the snare, to vary the tone. The mechanism frame serves to isolate the drum frame from the tension within the snares.

7 Claims, 1 Drawing Figure

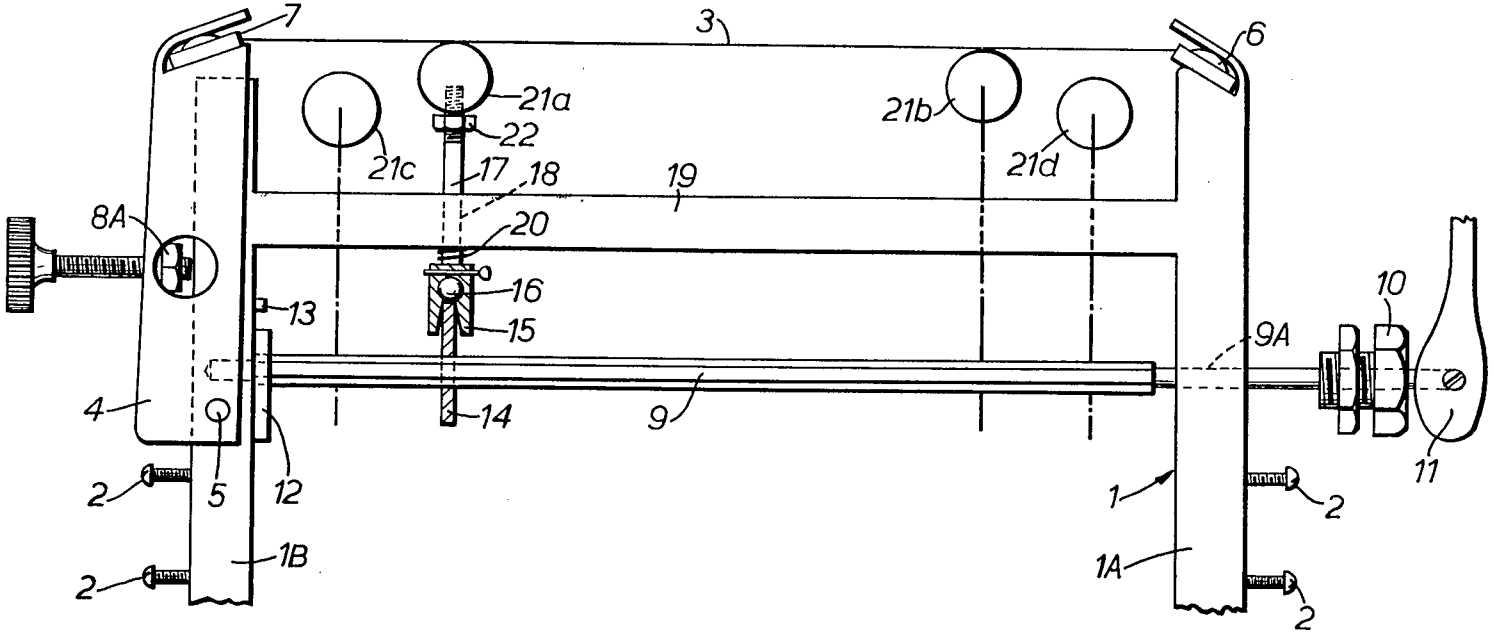
11
10
2
2
9A
6
1
1A
21d
21b
3
19
9
21a
22
18
20
16
15
14
17
21c
7
13
12
1B
5
8A
4
2
2

SNARE DRUM CONTROL MECHANISM

BACKGROUND OF THE INVENTION

This invention relates to snare drums and particularly to a control mechanism for varying the pressure applied by the snares of a drum.

In addition to the snares conventionally located beneath the lower or snare head of drums, snares are often fitted beneath the upper or batter head of the drum so as to enhance or modify the tone produced. Such snares, whether on the lower head alone or on both lower and upper heads, are normally secured at their opposite ends to the drum shell so that the shell carries the tension of the snare and can be distorted thereby.

An object of the invention is to provide means for varying the pressure exerted by the snares on the underside of the batter head, in such a way as to vary the tone.

Another object of the invention is to provide means whereby the tone of the snares can be varied or the snares can be moved completely free from engagement with the batter head.

A further object of the invention is to provide means whereby the tension of a snare cannot distort the drum shell.

SUMMARY OF THE INVENTION

According to the present invention there is provided a drum snare control mechanism comprising a frame for location within the shell of a snare drum, a snare mounted under tension on said frame, snare-support means on said frame movable into and out of a position in which they engage the snare at two spaced apart positions thereon leaving the length of snare therebetween free to vibrate, and tone-varying means operable at will to change the distance between said positions thereby to change the tone of the drum by a desired amount.

The invention also provides in a snare drum having a drum shell and a drum head, a drum snare control mechanism comprising a frame, a snare mounted under tension on said frame, a plurality of snare support members mounted on said frame and a manually operable mechanism for moving the support members selectively into engagement with the snare, said mechanism having a first position in which two of said snare support members engage the snare at positions spaced apart by a first distance, a second position in which two of said snare support members engage the snare at positions spaced apart by a second distance within and substantially shorter than said first distance, and a third position in which the snare support members are out of engagement with the snare.

The invention further provides in or for a snare drum having a drum shell and a drum head, a drum snare structure comprising a frame and a snare mounted under tension on said frame, the frame carrying the tension of the snare so that the drum shell will be free from the tension of the snare.

BRIEF DESCRIPTION OF THE DRAWING

The invention will now be described by way of example only with particular reference to the accompanying drawing which is a side elevational view of the snare tensioning mechanism of the present invention.

Within the shell of the drum there is mounted an H-section metal frame 1 of rectangular cross section: the frame being attached to the sides of the drum shell by screws 2 passing through the sides of the drum shell and engaging in tapped holes provided in the limbs 1A, 1B, of the H-section frame 1.

In order to adjust the tension applied to the snares 3 extending beneath the batter head (not shown) of the drum, limb 1B of the frame 1 is provided with a pivoted arm 4, the pivot being shown at 5 and the snares 3 extending between the limb 1A and the arm 4. The snares may be secured to the frame either by means of screws 6 engaging in tapped holes in the limbs 1A, 1B, or one or both ends of the snares may be anchored by means of a clip 7 supported in or forming part of the arm 4. A knurled adjusting screw 8 and nut 8A is provided to vary the position of the pivoted arm 4 thus exerting or relieving tension on the snares 3 as required, by varying the position of the arm 4 relative to the limb 1B of the frame 1.

In order to vary the pressure applied by the snares 3 on the underside of the batter head (not shown) an hexagonal rod 9 extends between the limbs 1A, 1B, of the frame 1, the rod passing through a bore 9A in limb 1A of the frame and extending through the wall of the drum shell (not shown) by way of a bush 10. A handle 11 is provided for adjustment of the rotation of the hexagonal rod 9 as hereinafter described. The end of the rod 9 remote from the handle 11 is provided with an arm 12 provided with an hexagonal hole to receive the hexagonal rod 9 and serving as a stop member to restrict the angular rotation of the rod 9, the stop member 12 being located on the rod 9 immediately adjacent the internal surface of the limb 1B and being arranged to engage a peg or projection 13 mounted on the limb 1B of frame 1 in the path of rotation of stop member 12. Alternatively, the arm 12 may be located on the rod 9 adjacent the limb 1A, with the projection 13 extending inwardly from the limb 1A.

The hexagonal rod 9 is provided with at least two cam discs 14 (only one of which is shown), each arm disc having a tappet 15 at the periphery thereof with a ball bearing 16 located within the tappet 15 for ease of movement. The tappet 15 carries a push rod 17 which passes through a bore 18 in the cross member 19 of the H-section frame 1, a spring 20 being interposed between the end of the tappet 15 and the cross member 19. The push rod 17 is arranged non-rotatably in the bore 18 in the cross member 19 and the end of the push rod 17 remote from the cam disc 14 is provided with a roller or pressure bar **21*a* arranged to engage the undersurface of the snare 3. An adjusting nut 22 is provided on the end of the push rod beneath the roller or pressure bar 21*a* to adjust the position of the latter before the batter head is placed over the snares. Preferably four cam discs 14 are spaced along the hexagonal rod 9 and arranged in pairs, the profiles of the two inner cam discs being arranged such that the cam discs control the movement of the inner pressure bars 21*a*, 21*b* and the profiles of the two outer cam discs being arranged as to control the movement of pressure bars 21*c*, 21*d* through the linkage formed by the spring loaded tappet 15 and push rod 17. The profiles of the cam discs are arranged such as to cause the inner pair to rise as the outer pair withdraw. The inner pair of pressure bars 21*a*, 21*b*** thus engage the snare on a shorter span than that engaged by the other pair or pressure bars, thereby producing a different tone.

The periphery of each cam disc may be provided with a detent or a plurality of detents and the profiles of the cam discs may be shaped to give continuous or step-by-step movement of the pressure bars against the snare. Thus movement of the handle 11 through 45° in one direction e.g. clockwise will cause one pair of pressure rollers to move through a position where no pressure is applied to the snare by the rollers to a position of maximum contact with the snare e.g. from a position of OFF to maximum tone and similarly, movement of the handle through 45° in the opposite direction i.e. counterclockwise will control the other pair of pressure rollers from an OFF position to a position of maximum contact with the snare. In other words, the movement of the handle controls the movement of the inner and outer cam discs from a long span position through OFF to a short span position in 90° of movement of the handle 11.

It will be appreciated that the invention is susceptible of considerable modification and is not to be deemed limited to the particular constructional features described by way of example only in the accompanying drawing. Any number of pairs of cam discs may be arranged on the hexagonal rod to give the required variation of tone and the rod may be of other than hexagonal section and may be of square or D-section.

I claim:

1. A drum snare control mechanism comprising a frame for location within the shell of a snare drum, a snare mounted under tension on said frame, snare-support means on said frame movable into and out of a position in which they engage the snare at two spaced apart positions thereon leaving the length of snare therebetween free to vibrate, and tone-varying means operable at will to change the distance between said positions thereby to change the tone of the drum by a desired amount, said snare-support means comprising a first pair of snare-support members spaced apart by a first distance and a second pair of snare-support members spaced apart by a second distance within said first distance, and said tone-varying means comprising a mechanism operable to move the first and second pairs of members alternately into engagement with the snare.

2. A drum snare control mechanism as claimed in claim 1 wherein each snare-support member comprises a roller or pressure bar mounted on said frame and arranged to engage the undersurface of the snare.

3. A drum snare control mechanism as claimed in claim 1 wherein said frame includes a cross member extending parallel to the snare and a pair of spaced limbs mounted at opposite ends of the cross member and between which the snare is tensioned, the cross member supporting the snare-support means.

4. A drum snare control mechanism as claimed in claim 1, including a rod rotatably mounted in said frame and a plurality of spaced cam members mounted on the rod for rotation therewith to move the snare support members towards and away from the snare.

5. A drum snare control mechanism as claimed in claim 3 having a plurality of cam members rotatably mounted on the frame, a corresponding plurality of tappets mounted on the frame each located at the periphery of a separate cam member, a corresponding plurality of push rods each carried by a separate tappet and each passing through a respective bore in said cross member, each push rod having the end thereof remote from the cam member provided with a respective one of said snare-support members.

6. A drum snare mechanism as claimed in claim 5 wherein the profiles of the outermost cam members are arranged out of phase with those of the inner cam members and a common driving member is connected to said cam members so that in a first position of the driving member, the first pair of support members engages the snare, in a second position of the driving member, the second pair of support members engages the snare, and in a third position of the driving member, the snare is free from said support members.

7. A drum snare control mechanism as claimed in claim 3 wherein an arm pivoted to one limb of the frame is connected at its outer end to one end of the snare, the other end of the snare being connected to the other limb of the frame and means are provided on said frame for varying the position of the pivoted arm relative to said one limb so as to vary the tension applied to the snare.

* * * * *

UNITED STATES PATENT OFFICE

CERTIFICATE OF CORRECTION

Patent No. 4,203,343 Dated May 20, 1980

Inventor(s) Harry Bargeman

It is certified that error appears in the above-identified patent and that said Letters Patent are hereby corrected as shown below:

Column 2, line 21, after "rod" insert -- 9 --.

Column 2, line 38, change "arm" to -- cam --.

Signed and Sealed this

*Twenty-first* Day of *October 1980*

[SEAL]

*Attest:*

SIDNEY A. DIAMOND

*Attesting Officer*

*Commissioner of Patents and Trademarks*